United States Patent [19]

Losch et al.

[11] Patent Number: 5,058,410

[45] Date of Patent: Oct. 22, 1991

[54] METHOD AND APPARATUS FO PRODUCING THIN WIRE, ROD, TUBE, AND PROFILES, FROM STEELS AND ALLOYS WITH LOW DEFORMABILITY, PARTICULARLY HARDENABLE STEELS

[75] Inventors: Hans Losch, Kapfenberg; Johann Eilmer; Franz Rischka, both of Bruck an der Mur, all of Austria

[73] Assignee: Boehler Gesellschaft M.B.H., Vienna, Austria

[21] Appl. No.: 323,395

[22] Filed: Mar. 14, 1989

[51] Int. Cl.[5] ..... B21B 45/02; B21B 3/02

[52] U.S. Cl. ..... 72/201; 72/202; 148/12 B

[58] Field of Search ..... 72/38, 128, 200, 201, 72/202, 700; 148/11.5 F, 12 R, 12 B, 12.1

[56] References Cited

U.S. PATENT DOCUMENTS

| | | | |
|---|---|---|---|
| 2,400,866 | 5/1946 | Kronwall . | |
| 3,228,220 | 1/1966 | Schneckenburger | 72/200 X |
| 4,060,428 | 11/1977 | Wilson et al. | 72/201 X |
| 4,727,747 | 3/1988 | Naud et al. | 72/38 |
| 4,745,786 | 5/1988 | Wakako et al. | 72/38 X |
| 4,909,058 | 3/1990 | Bindernagel et al. | 72/201 |

FOREIGN PATENT DOCUMENTS

| | | | |
|---|---|---|---|
| 51188 | 3/1890 | Fed. Rep. of Germany . | |
| 1184724 | 1/1965 | Fed. Rep. of Germany . | |
| 398402 | 4/1975 | Fed. Rep. of Germany . | |
| 2725155 | 12/1977 | Fed. Rep. of Germany . | |
| 3039101 | 5/1982 | Fed. Rep. of Germany . | |
| 2244002 | 4/1975 | France . | |
| 654496 | 2/1986 | Sweden . | |
| 798652 | 7/1958 | United Kingdom . | |
| 1206168 | 9/1970 | United Kingdom | 72/202 |

*Primary Examiner*—E. Michael Combs

*Attorney, Agent, or Firm*—Fleit, Jacobson, Cohn, Price, Holman & Stern

[57] ABSTRACT

A method and apparatus for performing forming operations on steels, metals, and alloys having low deformability and/or high resistance to deformation at room temperature, wherein the thickness of the stock material is small. In the method, stock material is heated by continuous rapid heating, to a temperature of at least 400° C. and at most the AC-1 temperature of the alloy, and the heated material is subjected to a two-stage or multistage forming operation wherein the overall reduction in cross section is substantial. The apparatus includes a heating device of the electrical induction or direct contact type, followed by a temperature equalization and guide device and a multi-stand roll forming mill which may have cooling devices between each stand.

1 Claim, 4 Drawing Sheets

METHOD AND APPARATUS FO PRODUCING THIN WIRE, ROD, TUBE, AND PROFILES, FROM STEELS AND ALLOYS WITH LOW DEFORMABILITY, PARTICULARLY HARDENABLE STEELS

BACKGROUND OF THE INVENTION

1. Field of the Invention

The invention relates to a method of performing forming operations on steels, metals, and alloys having low deformability and/or high resistance to deformation at room temperature, wherein the workpiece stock materials are particularly hardenable steels, e.g. high speed tool steels, the thickness of the stock material is small, preferably less than 10 mm, and the overall reduction of the cross section in the process is substantial. The invention further relates to an apparatus comprised of a heating device, a temperature equalization and guiding device, and a forming apparatus for carrying out the method.

2. Description of the Prior Art

Wire, rod, tube, and profiles, of small diameter, and possibly with thin walls, are customarily manufactured by a staged process comprising, first, hot forming of the stock, second possibly soft annealing, and then cold rolling or cold drawing. In most cases the thickness of the stock material is less than 10 mm.

In the course of cold forming, the material is hardened. As the degree of hardness increases, the ductility decreases and the resistance to deformation decreases. The limit of deformability is reached at low degrees of overall deformation. Materials which have high ductility at room temperature, and thus high cold deformability, can undergo high degrees of deformation in cold rolling and cold drawing, with decreases in cross section of, e.g., 10:1 (i.e. 90%) or more. In a case where the material has low cold-deformability and therefore hardens during the course of deformation such that it becomes impossible to process it further, i.e. by further cold rolling or cold drawing, to reach the desired final dimensions, and cracking and breakage occur due to exceeding the limits of deformability, in order to continue, the hardening must be reversed by heating to appreciable temperatures, or a stage of annealing must be resorted to. Such intermediate heat treatment breaks down the hardened structures in the material. For hardenable steels, particularly air-hardening steels such as tool steels and high speed tool steels, the intermediate heat treatment may comprise soft annealing. For economic reasons, however, in most cases any annealing must be for an extended period, possibly at a temperature below the austenitizing temperature or below the AC-1 point of the alloy, AC-1 being defined for purposes of this description as meaning the temperature at which austenite begins to be formed upon heating a steel.

In general if one is employing stock material having low deformability, such material cannot be subjected to forming operations to the desired final dimensions while in a ductile state at forging temperatures, because there is radiation energy loss from the surface, which radiation increases with the 4th power of temperature, and this energy loss leads to low temperatures in the zones near the surface, resulting in grain transformations and hardening of the material (in the case of hardenable steels and alloys). The reason for the rapid cooling which occurs is the low heat content of the material, in consequence of the small cross sectional area. Further, after a forming operation is performed on, e.g., hardenable alloys at forging temperatures, soft annealing must be carried out.

In order to avoid the need for heat treatment after forming, and to avoid hardening (where hardening is a limiting problem), and in order to increase the deformability and thereby to increase the degree to which the cross section of the material can be reduced, it has been proposed to carry out the forming at elevated temperature, subject to a possible upper limit of the austenitizing temperature or the AC-1 point of the alloy. A difficulty faced in this proposal is that of ensuring that the deformation energy applied in a given cross sectional region does not itself lead to a temperature increase to a point above the AC-1 point.

Drawing has proved to be advantageous for the deformation process at elevated temperature, because energy is produced by the friction in the drawing die and by the principal deformation in the zone of the stock near the surface thereof, and this energy substantially completely compensates for the radiation losses. The temperature distribution over the cross section is improved, i.e. is more uniform which enables greater degrees of area reduction to be achieved per forming step. If a plurality of drawing steps is employed, to enable achieving a high overall degree of reduction of the starting cross sectional area, and if one achieves this increase in the reduction of cross sectional area per step, then the number of drawing passes can be reduced, along with the number of de-hardening steps, which steps are carried out between respectively successive drawing passes. However, the drawing speed of the materials at elevated temperature must be kept low, e.g. 0.2–2 m/sec, because otherwise excessive wear on the drawing die is experienced due to forcing away of the lubricant film; and further, the time required for the preparatory heating and de-hardening of the material is long, necessitating uneconomically long heating segments in the system.

As an example, a soft-annealed high speed tool steel wire (material DIN No. 1.3343) with a diameter of 5.5 mm can be continuously drawn from a reel into a lead bath with a length of 10 m and a bath temperature of 700° C., with a residence time of 20 sec in the bath, to heat and anneal the material. This is followed by drawing in a drawing die to a diameter of 4.7 mm, with a speed of 0.5 m/sec, following which the wire is respooled. The deformation experienced is about 27%. The wire is thereafter brought to a diameter of 1.6 mm, in seven further similar drawing steps, and four de-hardening annealing steps may be included between pairs of the seven drawing steps, these intermediate annealings being carried out under oxidation protection at 800° C. and an annealing time of 1 hr. each. For each drawing step, a lead bath is employed prior to the drawing, to bring the material to temperature and further relax any hardening.

It is a disadvantage to have to employ a large number of steps with intermediate de-hardening annealing, when forming by drawing at elevated temperature, when the stock comprises steels or alloys, particularly hardenable steels, of relatively thin dimension. The arrangement is costly, the drawing speeds are low, there are problems with high temperature drawing means and agents (lubricants etc.), and the wear on the dies is high.

BRIEF SUMMARY OF THE INVENTION

The object of the invention is to overcome the above-mentioned underlying problem and disadvantages, and to provide a method and apparatus for achieving a substantial overall decrease in cross section in a single operation (which may employ a train of operating stages), whereby the desired final cross section can be achieved and the dimensions can be selected over an extremely wide range.

This problem is solved by a method of the general type described initially above, in that the stock material is heated to 400°-1100° C., with the maximum temperature being preferably 950° C., or possibly the AC-1 temperature, or the temperature of conversion to the gamma metallographic structure of the alloy, and in that a forming operation in two or more stages is employed in which the overall reduction of the cross section of the material is substantial. It is preferable if the method of heating the stock is continuous rapid heating, in which it is advantageous if the heating is accomplished by direct passage of current through the material, with the length of the heating segment of the system being variable, and if the electric power, which is a function of the cross sectional area, the average specific heat, and the density, of the material, is regulated so as to be proportional to the feeding speed of the material being heated and inversely proportional to the length of the heating segment of the system. It is also a feature of this invention to carry out the final heating, or preheating of the stock material prior to the start of the forming operation over a heating segment of the system which is a short segment. It is particularly advantageous and economically significant if the forming operations on the stock material are accomplished by rolling, and if an overall decrease in cross section of at least 40%, preferably at least 60%, is accomplished. In this connection, the forming in each roll stand should achieve a decrease in cross section of at least 10%, preferably at least 15%, or a decrease in height of at least 20%, preferably at least 30%, on the material undergoing rolling. It may be advantageous to employ cooling of the rolled material. The order of magnitude of such cooling should be regulated to correspond to the deformation energy converted to heat in the preceeding pass or in a group of preceding passes. In addition, the method is particularly suitable and economical if the feeding speed of the stock in to the first roll gap is at least 0.2 m/sec, preferably at least 0.5 m/sec. The forming operations on the stock may be carried out in a multiroll mill.

Further, the invention provides an apparatus for carrying out the method, in which a heating device (preferably electrical) is employed (wherein the heating is produced by induction or by direct flow of current through the material being heated, with a variable length of the heating segment of the system), and possibly with the use of a temperature equalization device with a protective gas atmosphere for inhibiting oxidation. Following the heating device is a forming unit, which preferably is comprised of a two-stand or multi-stand rolling mill, preferably a mill with coordinated rolls. Controllable cooling devices may be disposed between the roll stands. It has proved particularly advantageous if the device for temperature equalization and guiding of the stock material is heatable and can be supplied with a protective gas atmosphere. In order to achieve particularly good rolling results it is advantageous for flat products and profiles if the sequence of rolling gaps is alternately open and closed, and wherein the last gap is a closed groove for rolling to final dimensions. When manufacturing products with a round cross section. e.g. wires, it is advantageous if a closed groove configuration is employed in all roll stands. Particularly good results, and economical conditions, are achievable if cooling devices are disposed between successive roll stands, whereby the roll surfaces and/or rolled material may be contacted with coolant in a controlled fashion. Particular economic benefit is obtained if the rolls are comprised of hard metal or tempered high speed tool steel material, and preferably have a coating of the like of hard material formed of oxide and/or nitride and/or carbide, and/or compounds of these, e.g. oxycarbonitride. Advantageously, for specific cross sectional shapes of the products the forming unit of the apparatus comprises one or more multi-roll roll mills.

It has been found, quite surprisingly, in connection with the invention, that the temperature increase in the core of the material due to the extensive deformation occuring in the rolling is quite small, so that, e.g. when hardenable steels are rolled, the AC-1 temperature is not exceeded, even in the center of the material. This result pertains even when the rolling temperature is only slightly below the AC-1 temperature of the alloy being rolled, and the speed of advance of the material through the rolls can be substantially higher than the admissible speed through a drawing die. Until this discovery was made, it was not valid to assume that if one employs multi-stand rolling in a train in a single operating stage, and/or if one employs high speeds of forming, possibly employing surface cooling, the temperature distribution could be adjusted between the rolling steps so that the temperature would nowhere exceed a specified temperature, e.g. the AC-1 temperature.

Furthermore, the prior opinion among those skilled in the art, to the effect that material hardening occurs and the deformation limits are rapidly reached in the case of rolling a plurality of times in succession in a single rolling operation, and that the time between individual rolling deformations is inadequate for de-hardening processes in the material to proceed appreciably due to the fact that the decrease in cross section results in a high rolling speed has been disproved by this invention.

BRIEF DESCRIPTION OF THE DRAWINGS

Preferred embodiments of the invention are described in greater detail hereinbelow with reference to the accompanying drawings wherein.

DETAILED DESCRIPTION

Figure 1:
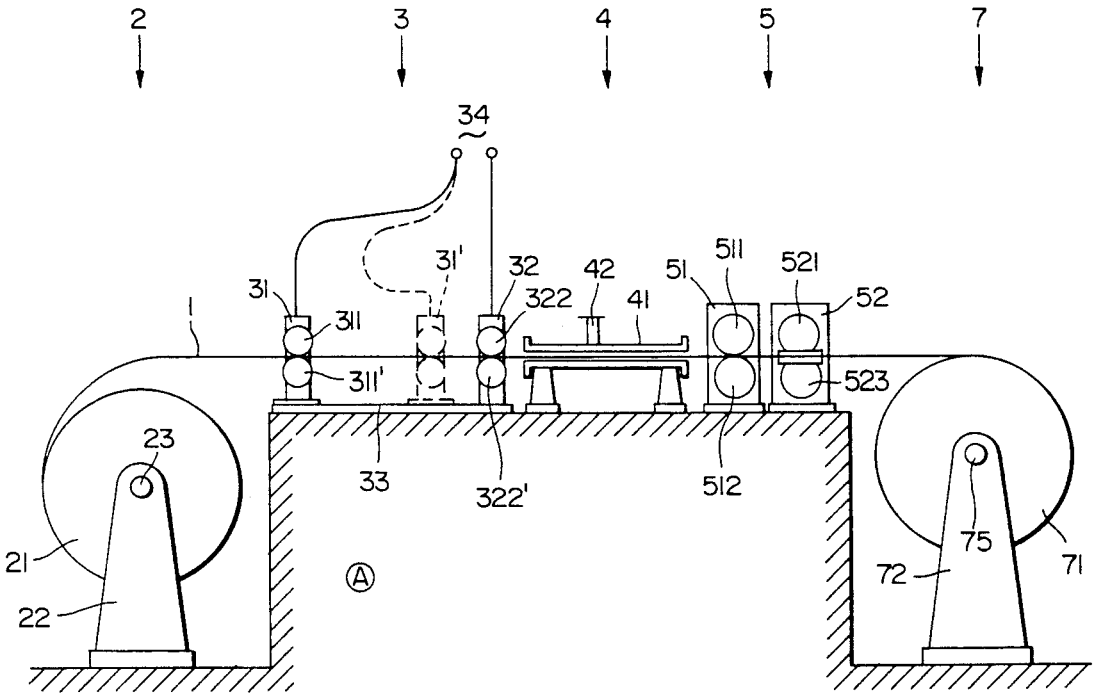
FIG. 1 is a schematic elevational view of an apparatus for manufacturing a shallow profile from round material wherein a double-stand rolling mill follows a heating and temperature equalization device according to the invention.

In FIG. 1, a rolling mill mounted on a base A is shown schematically, which mill produces a wide profile 8 mm×1 mm from round wire stock with diameter 3 8 mm. Stock material 1 is withdrawn from a supply reel device generally shown at 2 in which a supply reel 21 is rotatably mounted on a support 22 by bolts 23, for example. The stock is heated in a rapid heating device generally shown at 3, is passed through a temperature equalization and guiding device generally shown at 4, and is fed directly to the rolls. In terminal coiling device 7, the flat profile strip, true to gauge, is coiled onto a drum 71 which drum is driven by a shaft 73 and is rotatably mounted on a support 72.

At the beginning of the rolling the contact roll stand 31, which is slidable on a support 33, is moved to a position 31′ near a second contact roll stand 32, whereby the heating segment of the system is shortened. The stock material 1, which is in the form of a wire of diameter 3.8 mm, is comprised of, e.g., high speed tool steel DIN No. 1.3343, in a soft annealed state, and is passed through the gap between contact rolls 311 and 311′ into position 31′, until the material establishes an electrically conducting connection with a contact roll pair 322, 322′, whereupon current is supplied via terminals 34. The stock is heated by direct or alternating current passing through it. When 800° C. is reached, the wire is advanced into a guiding and temperature equalization tunnel 41, with simultaneous sliding of the contact roll stand 31 and thereby elongation of the heating segment of the system. The tunnel is preheated from a connecting conduit 42, through which may be supplied a heated inert gas such as inert flue gas, for example. A separate roll pair (not shown) may be employed for advancing the wire, or the contact rolls of one or both of the contact roll stands may be utilized. The material leaves the tunnel and its guide at a temperature of 500° C. and with a diameter of 3.8 mm.

Figure 2:
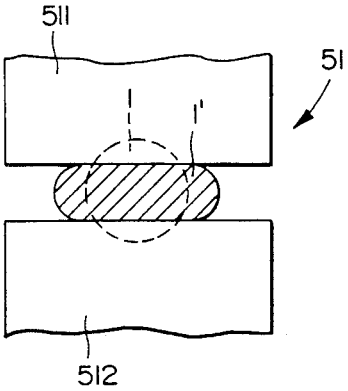
FIG. 2 is an elevational view showing the first pass with free widening, the workpiece being shown in cross section.

In a first roll stand 51 it is rolled to a thickness of 2 mm and mean width of 5.3 mm. As illustrated in FIG. 2, the rolling occurs with free widening between rolls 511 and 512. The decrease in thickness is about 47%, the widening is about 40%, and the degree of deformation, as decrease in cross section, is about 6%. In FIG. 2, the original cross section 1 of the stock can be compared with the rolled cross section 1′.

Figure 3:
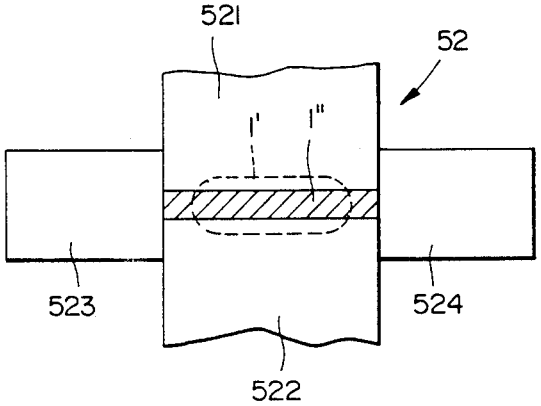
FIG. 3 is a view similar to FIG. 2 showing the second pass with a closed groove.

Immediately after this first roll pass, the material which has been rolled in the first stand 51 is reduced to the desired cross section of 1×8 mm in a second stand 52 having a closed groove (FIG. 3). An upper roll 521 and a lower roll 522 have a gap between them of 1 mm. Lateral or side rolls 523 and 524 are disposed on respective sides of the upper and lower roll, to limit the widening to the desired dimension of 8 mm. In this finishing pass in which the material is rolled to size, the decrease in thickness is about 50%, the widening is about 51%, and the decrease in cross section is about 25%. The feed speed to the first stand of the stock having a temperature of 800° C. is 0.8 m/sec, and the exit speed from stand 52, which is the speed at which the high speed tool steel strip is subsequently coiled, is about 1.13 m/sec, with the temperature being 810° C. immediately following the last rolls. The total degree of deformation in the two-stage rolling process is about 30%. Studies carried out on product produced (continuously and without cutting or interruption) by the above-described method showed that dimensions of the wide, flat strip were true to within tolerances, over the entire length of the product, and the edges were sharp without defects.

Tests with stock temperatures below 400° C., including room temperature tests, showed that when, e.g., hardenable steels such as high speed tool steels are rolled in this temperature range, the alloy is hardened to the extent that there are at least regions in which further deformability is not possible. Along with increased wear on the rolls, the material suffers cracking and breakage, particularly in the region of the edges of the strip. Additional studies reveal that at temperatures of the stock slightly below the AC-1 temperature of the alloy, the temperature equalization device can be shortened or even eliminated, whereby the wire will be fed to the first roll stand via a guiding device which does not have associated with it a temperature equalization device.

Figure 4:
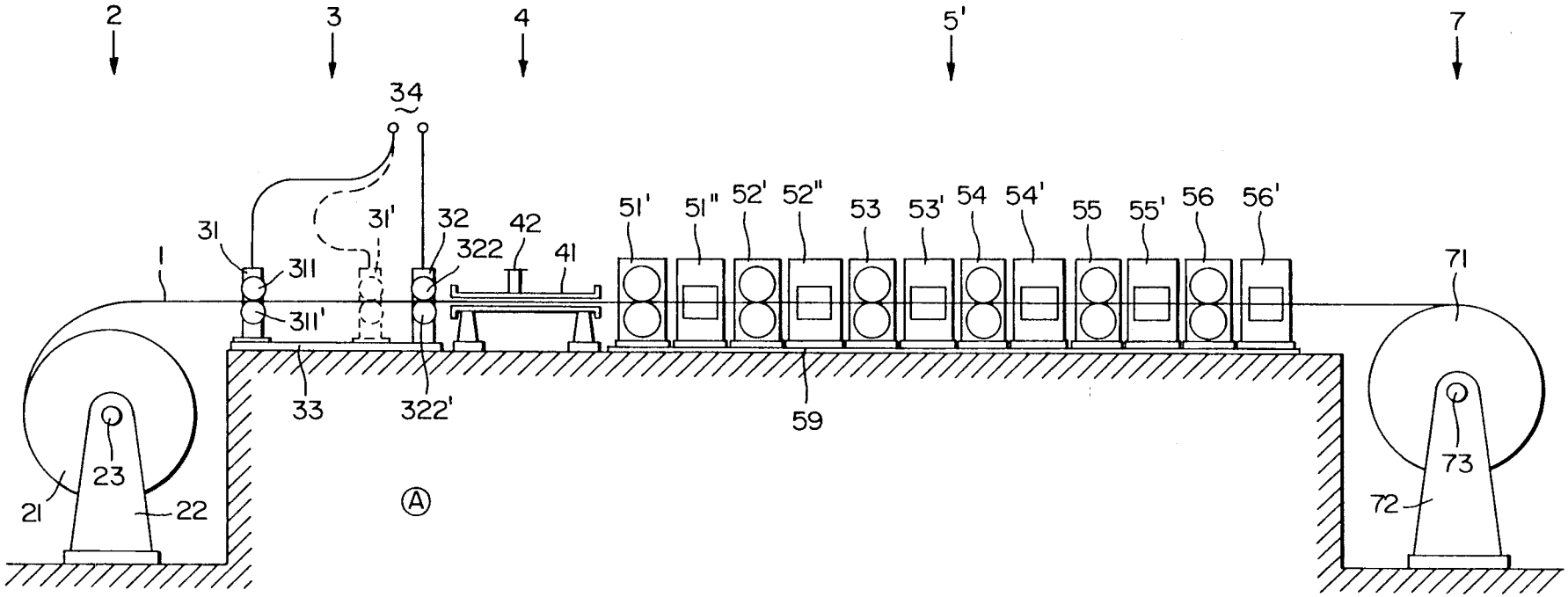
FIG. 4 is a view similar to FIG. 1 showing a rolling train for round profiles, with coordinated rolls ("cassette roll mill")

FIG. 4 shows schematically an apparatus mounted on a base B, for manufacturing a round wire with a diameter of 1.8 mm from a round stock material of diameter 5.5 mm, with the use of a 12-stand rolling train or a coordinated rolling system.

Figure 5:
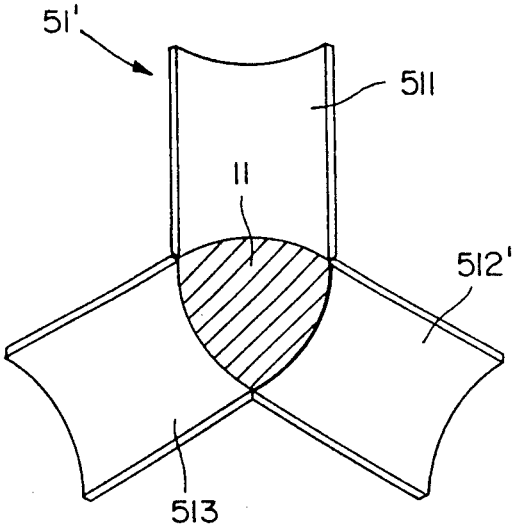
FIG. 5 is a view similar to FIG. 3 showing a three-roll triangular groove.
Figure 6:
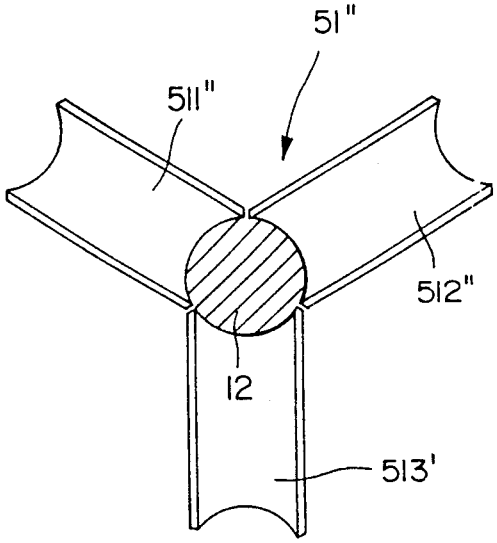
FIG. 6 is a view similar to FIG. 5 showing a three-roll round groove.

The stock 1 is delivered from the reel device 2 in which the reel 21 is rotatably mounted on a support 22 by a bolt 23, for example, is brought to 780° C. in fast heating device 3, is passed through the temperature equalization and guiding device 4, and is formed in a coordinated rolling system 5′. The wire having undergone the complete forming operation to final dimensions is then coiled on drum 71 of terminal coiling device 7, which drum is supported on support 72 and is driven by shaft 73. The roll stand 51′ of forming device 5′ may have, e.g., a three-roll triangular groove, as shown schematically in FIG. 5. The working surfaces of rolls 511′, 512′, and 513 produce a groove cross section 11 in the form of a convex curved triangle. The associated next roll stand 51″ may also have three rolls (FIG. 6), with the shape of the working surfaces of the rolls (511″, 512″, and 513′) producing a circular groove cross section 12. The sequences and shapes of grooves and the decreases in cross sections between stands 52′ and 52″, 53 and 53′, 54 and 54′, and 55 and 55′, respectively, may be the same as for stands 51′ and 51″. Similarly the number sequences for the rolls of the stands 52 through 56′ are the same as for stands 51′ to 51″, i.e. stand 52′ has rolls 521′, 522′, 523, stand 53 has rolls 531, 532, 533 and stand 56 has rolls 561, 562, 563. In the rolling the triangular groove need not be totally filled; however, due to the required product dimensions and tolerances the round groove must be filled.

Stock comprised of, e.g., DIN No. 1.3247 material in the soft annealed state, with a diameter of 5.5 mm, is rolled to a diameter of 1.8 mm in a device such as described in its essence above. The material is heated to 780° C. in the rapid heating device, at a conveying speed of 0.5 m/min. The power drawn from the mains 34 for this is about 45 kW. In general the power requirement to reach a given stock temperature is proportional to the speed of the material and inversely proportional to the length of the heating segment of the system. Thus, it is easy to regulate the process for changed parameters. The final heating, or preheating of the stock material prior to the forming operation may be carried out over a heating segment which is short.

When the stock is passed through the temperature equalization and guiding tunnel 41 supplied with inert flue gas i.e. hot gas, which tunnel has a length of 2 m, there is no appreciable temperature change. In the forming device 5' (a 12-stand coordinated rolling system), the forming is accomplished with groove dimensions and associated degrees of deformation as per Table 1, below.

TABLE 1

| Roll stand groove outer dimension (initial = 5.5 mm) (T = triangular, R = round) | | | Degree of deformation (between successive round shapes) |
|---|---|---|---|
| 51' | 5.3 mm, | T | |
| 51" | 4.9 mm, | R | 21% |
| 52' | 4.5 mm, | T | |
| 52" | 4 mm, | R | 34% |
| 53 | 3.7 mm, | T | |
| 53' | 3.25 mm, | R | 34% |
| 54 | 3.0 mm, | T | |
| 54' | 2.7 mm, | R | 31% |
| 55 | 2.6 mm, | T | |
| 55' | 2.2 mm, | R | 33% |
| 56 | 2.0 mm, | T | |
| 56' | 1.8 mm, | R | 33% |
| Final diameter = | 1.8 mm, | R, | |
| overall degree of deformation = 89%. | | | |

The round wire leaves the final groove at a speed of 4.7 m/sec, corresponding to an overall deformation of cross section of about 89%.

Figure 7:
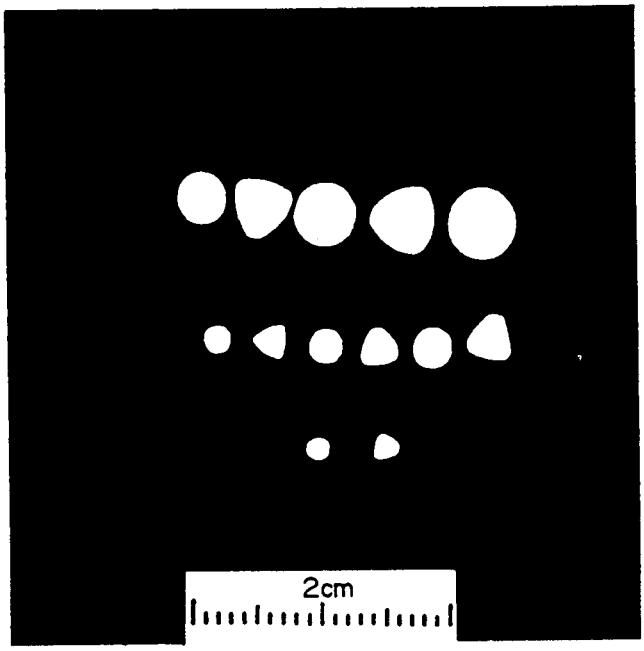
FIG. 7 is a view showing cross sectional shapes of the rolled stock in a twelve-stand rolling train.

The individual cross sections produced as a result of the respective groove designs, and present following the respective stages, are shown in FIG. 7 which shows transverse cuts of the rolled material. The initial cross section of diameter 5.5 mm is shown at the top right, and the final cross section, of diameter 1.8 mm, is shown at the bottom left. Studies on the rolled material show it to be completely true to size (within the given tolerances), which indicate that the deformation capability of the material is realized at temperatures of 400°-1-1OO° C., the maximum being preferably 950° C. or the AC-1 temperature, even with rolling at high degrees of decrease in cross section.

Figure 8:
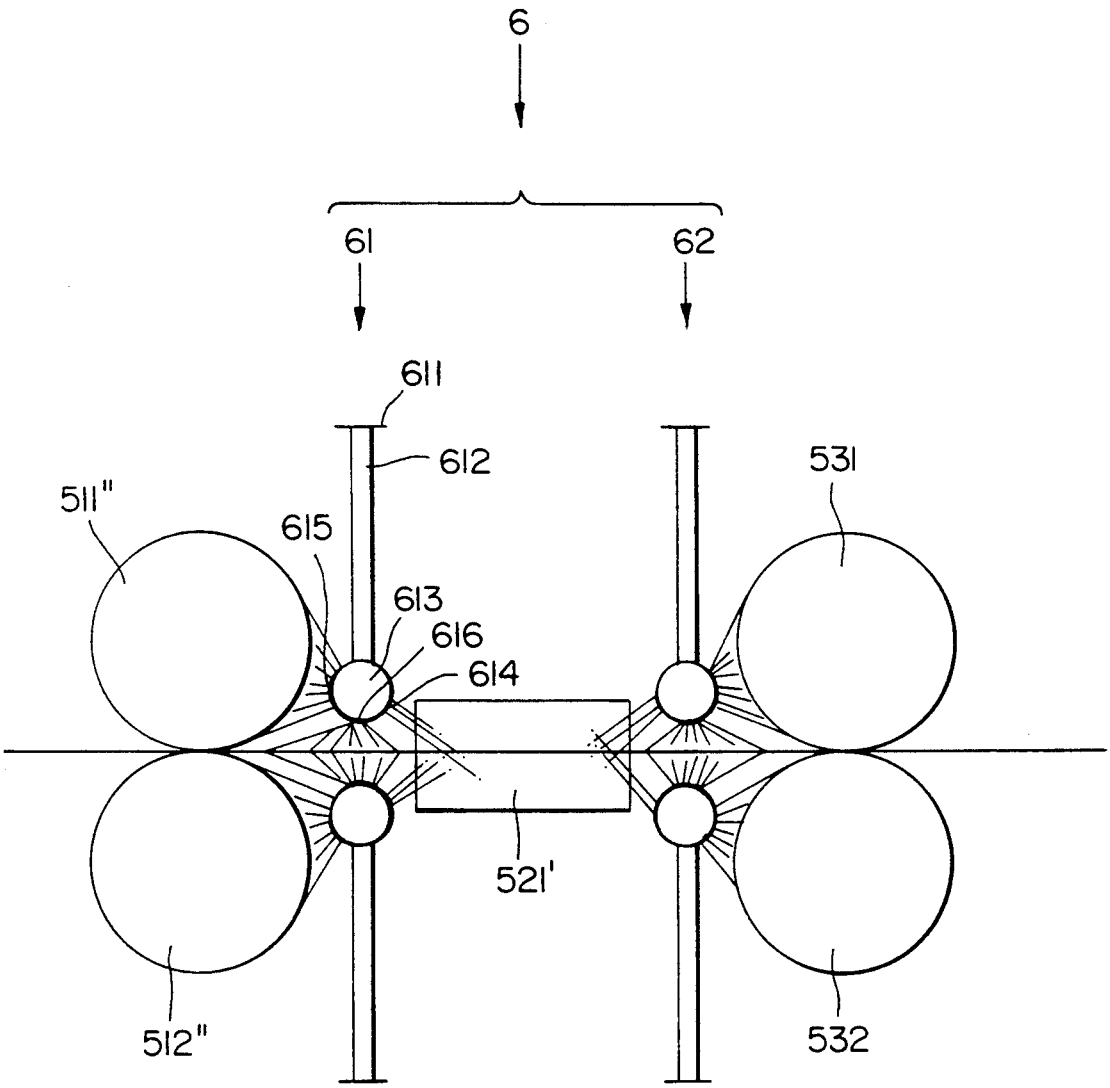
FIG. 8 is a schematic elevational view showing a cooling device for rolls and rolled stock.

Cooling devices generally indicated at 6 may be disposed between the roll stands. Such devices are illustrated schematically in FIG. 8, which shows a cooling element 61 positioned between rolls 511", 512" and 521'. Referring to the upper cooling element, the element is comprised of, e.g., a connection 611 to a source of coolant, a coolant feed line 612, and a nozzle head 613. The nozzles 615, 614 enable the rolls 511" and 521', respectively, to be contacted with coolant, the flow from nozzles 616 being directed at the rolled material. The individual streams of coolant may be provided with individual means of regulation (not shown). The description of the cooling devices have been shown and described above only with respect to a single cooling device between two stands, but it will be understood that the cooling devices for all stands are the same.

From an economic and engineering standpoint, it has proved advantageous to employ hard metal (i.e., carbides) or tempered high speed tool steel as the material of the rolls. The opinion of those skilled in the art ha been that it is not beneficial, and may be detrimental tc the rolling process, to apply layers or coatings of harc material to the working surfaces of the rolls in order tc reduce wear on the rolls, because such layers or coat ings reduce friction between the working surfaces of thc rolls and the surfaces of the rolled material, thereby detracting from the capacity to pull the rolled materia into the roll gap. However, surprisingly, it has beer found in connection with the invention that if the appa ratus has at least two roll stands in succession in thc rolling direction with each stand having two or morc rolls, no detriment to the rolling process is experiencec when the working surfaces of the rolls are covered witl hard material, and that in fact the service life of the rolls is greatly increased and the quality of the rolled material is improved.

We claim:

1. A method of forming steels, metals, and alloys with low deformability and/or high resistance to deformation at room temperature from workpiece stock materials of particularly hardenable steels having a thickness less than 10 mm comprising:

heating the stock material to a temperature within the range of 400° C. to AC-1 temperature, said heating comprising, continuous rapid heating by passing alternating or direct current through a segment of said stock material and varying the length of said heated segment of said stock material, regulating the power required to heat the material, as a function of the cross-sectional area, the average specific heat and the density of the material, to be proportional to the feeding speed of the material and inversely proportional to the length of said heated segment, carrying out the heating of the stock material prior to the start of the forming operation over a heating segment which is short, and feeding said stock material through a temperature equalization operation for a time period of at least 0.5 seconds;

feeding said heated stock material at a speed of at least 0.2 m/sec. to a multi-roll rolling mill;

rolling said stock material in said rolling mill in a plurality of stages wherein the reduction in cross-section in each stage comprises at least 10% and the reduction in height comprises at least 20%, and the overall reduction in cross-section comprises at least 40%;

cooling in cooling stages at least one of the surfaces of the rolls and the rolled stock material after each roll forming stage; and regulating said cooling in each cooling stage so that the energy removed substantially corresponds to the deformation energy converted to heat in the preceding roll forming stage.

* * * * *